US011542624B2

(12) United States Patent
Tsuji

(10) Patent No.: US 11,542,624 B2
(45) Date of Patent: Jan. 3, 2023

(54) PLATING APPARATUS

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 37 days.

(21) Appl. No.: 17/471,609

(22) Filed: Sep. 10, 2021

(65) Prior Publication Data

US 2022/0106700 A1 Apr. 7, 2022

(30) Foreign Application Priority Data

Oct. 1, 2020 (JP) ..... JP2020-166879
Jun. 29, 2021 (JP) ..... JP2021-107551

(51) Int. Cl.
*C25D 17/02* (2006.01)
*C25D 17/06* (2006.01)
*C25D 17/00* (2006.01)

(52) U.S. Cl.
CPC ..... *C25D 17/008* (2013.01); *C25D 17/001* (2013.01); *C25D 17/02* (2013.01); *C25D 17/06* (2013.01)

(58) Field of Classification Search
CPC ..... C25D 17/008; C25D 7/12–123; C25D 17/001; H01L 21/2885; H01L 21/76873
See application file for complete search history.

(56) References Cited

U.S. PATENT DOCUMENTS 5,256,274 A * 10/1993 Poris ..... H01L 21/76885 257/E21.589
6,027,631 A * 2/2000 Broadbent ..... C25D 21/00 205/137
2003/0057093 A1* 3/2003 Klocke ..... C25D 7/12 204/276
2012/0292181 A1* 11/2012 McHugh ..... C25D 17/008 204/260
2016/0201212 A1* 7/2016 Ostrowski ..... C25D 17/005 204/297.01
2019/0390360 A1 12/2019 Shimomura et al.

FOREIGN PATENT DOCUMENTS

JP 2008-019496 A 1/2008
JP 2010138433 A * 6/2010
JP 2019-218618 A 12/2019

OTHER PUBLICATIONS

Furuya, Machine Translation, JP 2010-138433 A (Year: 2010).*

* cited by examiner

*Primary Examiner* — Ho-Sung Chung
(74) *Attorney, Agent, or Firm* — BakerHostetler

(57) ABSTRACT

Provided is a technique that can suppress remaining of air bubbles on a lower surface of an electric field shielding plate. A plating apparatus 1000 include a plating tank 10, a substrate holder 30, and an electric field shielding plate 60 configured to be arranged in a portion between an anode 50 and a substrate Wf in an inside of the plating tank for shielding a part of an electric field formed between the anode and the substrate. In a top view of the electric field shielding plate, in the inside of the plating tank, an unshielded region 70 that is without shielded by the electric field shielding plate is disposed. An inclined surface is disposed in a lower surface 61*a* of the electric field shielding plate, the inclined surface is inclined with respect to a horizontal direction and is configured to release an air bubble existing on the lower surface thereof to the unshielded region.

6 Claims, 13 Drawing Sheets

(A1-A1)

PLATING APPARATUS

TECHNICAL FIELD

The present invention relates to a plating apparatus. This application claims priority from Japanese Patent Application No. 2020-166879 filed on Oct. 1, 2020 and Japanese Patent Application No. 2021-107551 filed on Jun. 29, 2021. The entire disclosure including the descriptions, the claims, the drawings, and the abstracts in Japanese Patent Application No. 2020-166879 and Japanese Patent Application No. 2021-107551 is herein incorporated by reference.

BACKGROUND ART

Conventionally, there has been known what is called a cup type plating apparatus as a plating apparatus for performing a plating process on a substrate (for example, see PTL 1). Such a plating apparatus includes a plating tank in which an anode is arranged, and a substrate holder that is arranged above the anode and holds a substrate as a cathode such that a surface to be plated of the substrate is opposed to the anode.

Further, conventionally, there has been also known a technique for arranging an electric field shielding plate that shields a part of an electric field formed between an anode and a substrate (referred to as a regulation plate in PTL 2) between the anode and the substrate in order to suppress thickening of a film thickness of an outer peripheral portion of a plating film due to a terminal effect (for example, see PTL 2).

CITATION LIST

Patent Literature

PTL 1: Japanese Unexamined Patent Application Publication No. 2008-19496

PTL 2: Japanese Unexamined Patent Application Publication No. 2019-218618

SUMMARY OF INVENTION

Technical Problem

It is considered that, in the conventional cup type plating apparatus as exemplified in PTL 1, the technique as exemplified in PTL 2 is applied to arrange the electric field shielding plate in a portion between the anode and the substrate inside the plating tank. However, in a case of such a plating apparatus, air bubbles inside a plating solution possibly remain on a lower surface of the electric field shielding plate. Thus, when the air bubbles remain on the lower surface of the electric field shielding plate, a function of the electric field shielding plate is possibly inhibited due to the air bubbles and plating quality of the substrate possibly gets worse.

The present invention has been made in view of the above, and one of the objects of the present invention is to provide a technique that can suppress remaining of air bubbles on a lower surface of an electric field shielding plate.

Solution to Problem

[Aspect 1]

In order to achieve the object, a plating apparatus according to one aspect of the present invention include a plating tank, a substrate holder, and an electric field shielding plate. The plating tank is for accumulating a plating solution. The plating tank includes an anode. The substrate holder is arranged above the anode for holding a substrate as a cathode such that a surface to be plated of the substrate is opposed to the anode. The electric field shielding plate is configured to be arranged in a portion between the anode and the substrate in an inside of the plating tank for shielding a part of an electric field formed between the anode and the substrate. In a top view of the inside of the plating tank viewed from above the electric field shielding plate, in the inside of the plating tank, an unshielded region that is without shielded by the electric field shielding plate is disposed. An inclined surface is disposed in a lower surface of the electric field shielding plate, the inclined surface being inclined with respect to a horizontal direction, the inclined surface being configured to release an air bubble existing on the lower surface of the electric field shielding plate to the unshielded region.

With this aspect, the air bubbles existing on the lower surface of the electric field shielding plate can be effectively released to the unshielded region by the inclined surface. This can suppress remaining of the air bubbles on the lower surface of the electric field shielding plate. Consequently, since inhibiting a function of the electric field shielding plate due to the air bubbles remaining on the lower surface of the electric field shielding plate can be suppressed, plating quality of the substrate getting worse can be suppressed.

[Aspect 2]

In the aspect 1, the electric field shielding plate may extend from an outer peripheral portion of the plating tank toward a center side of the plating tank.

[Aspect 3]

In the aspect 2, the inclined surface may incline such that a distance from a bottom portion of the plating tank increases as approaching the center side of the plating tank.

[Aspect 4]

In the aspect 2 or 3, the inclined surface may incline such that a distance from a bottom portion of the plating tank increases as approaching one side in a circumferential direction of the plating tank.

[Aspect 5]

In the aspect 4, the inclined surface may incline such that the distance from the bottom portion of the plating tank increases as approaching another side in a circumferential direction of the plating tank.

[Aspect 6]

In the aspect 2 or 3, the electric field shielding plate may be connected to a whole in a circumferential direction of the outer peripheral portion of the plating tank and has a ring shape in the top view.

[Aspect 7]

In any one of the aspects 2 to 5, the electric field shielding plate may be connected to a part in a circumferential direction of the outer peripheral portion of the plating tank and has a non-ring shape in the top view.

[Aspect 8]

In any one of the aspects 2 to 5, the electric field shielding plate may have: a ring-shaped portion connected to a whole in a circumferential direction of the outer peripheral portion of the plating tank and having a ring shape in the top view, and a non-ring-shaped portion connected to a part in a circumferential direction of the ring-shaped portion and having a non-ring shape in the top view.

[Aspect 9]

In any one of the aspects 1 to 8, the plating apparatus may further include a porous ionically resistive element configured to be arranged between the anode and the substrate in the inside of the plating tank. The electric field shielding plate is arranged below the ionically resistive element or above the ionically resistive element.

[Aspect 10]

In any one of the aspects 1 to 5, the plating apparatus may further include a porous ionically resistive element configured to be arranged between the anode and the substrate in the inside of the plating tank. The electric field shielding plate may be arranged below the ionically resistive element or above the ionically resistive element. The electric field shielding plate may be connected to a whole in a circumferential direction of an outer peripheral edge of the ionically resistive element and has a ring shape in the top view.

[Aspect 11]

In any one of the aspects 1 to 5, the plating apparatus may further include a porous ionically resistive element configured to be arranged between the anode and the substrate in the inside of the plating tank. The electric field shielding plate may be arranged below the ionically resistive element or above the ionically resistive element. The electric field shielding plate may be connected to a part in a circumferential direction of an outer peripheral edge of the ionically resistive element and has a non-ring shape in the top view.

DESCRIPTION OF EMBODIMENTS

Figure 1:
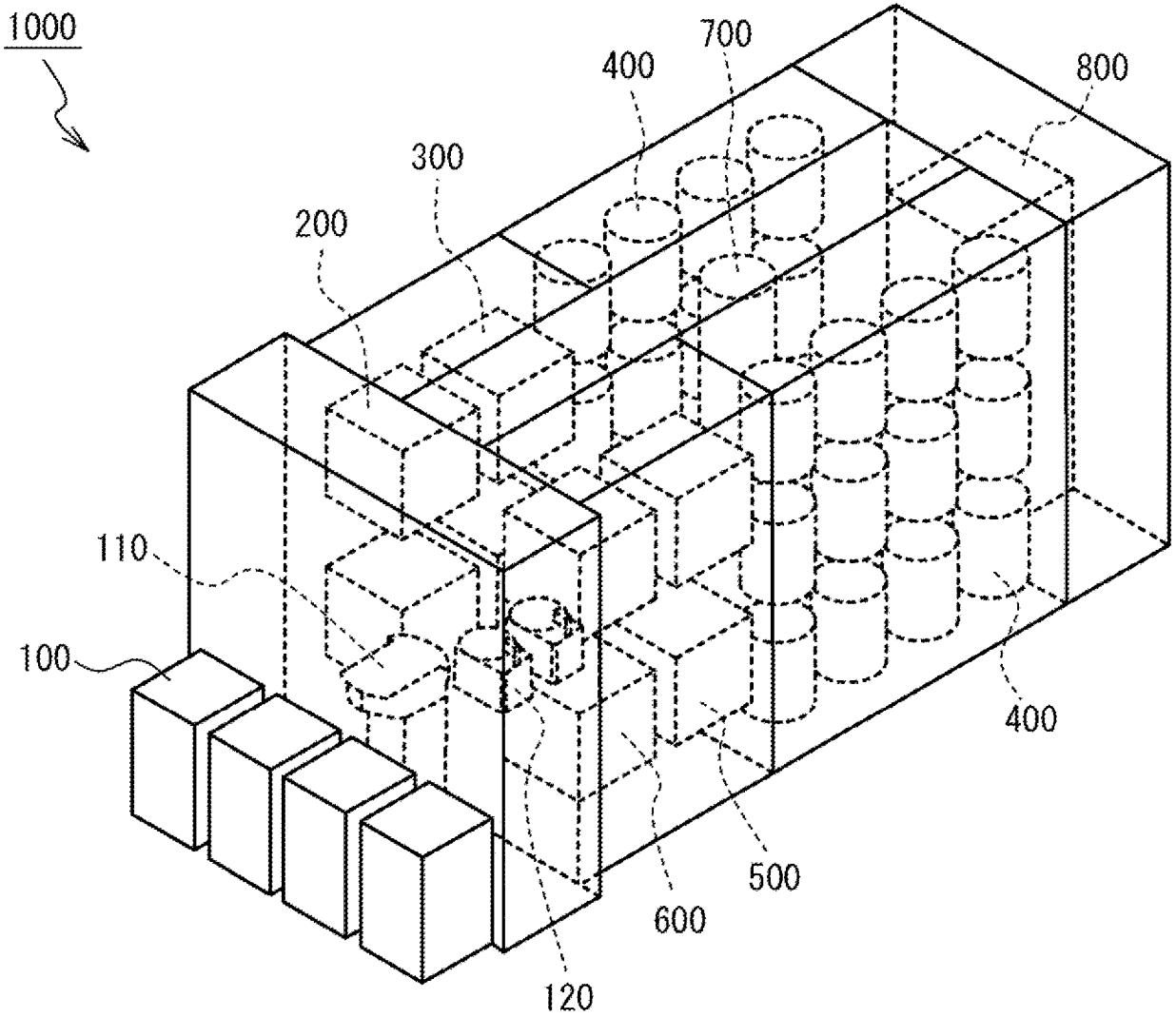
FIG. 1 is a perspective view illustrating an overall configuration of a plating apparatus of this embodiment.

The following will describe an embodiment of the present invention with reference to the drawings. Note that, in the following embodiment and modifications of the embodiment, the identical reference numerals are assigned for the identical or corresponding configurations, and their descriptions may be appropriately omitted. Further, the drawings are schematically illustrated to facilitate understanding of the features of the embodiment, and dimensional proportions and the like of each component are not necessarily the same as the actual ones. Further, in some drawings, orthogonal coordinates of X-Y-Z are illustrated for reference. Of the orthogonal coordinates, the Z direction corresponds to an upper side, and the −Z direction corresponds to a lower side (direction in which gravity acts).

Figure 2:
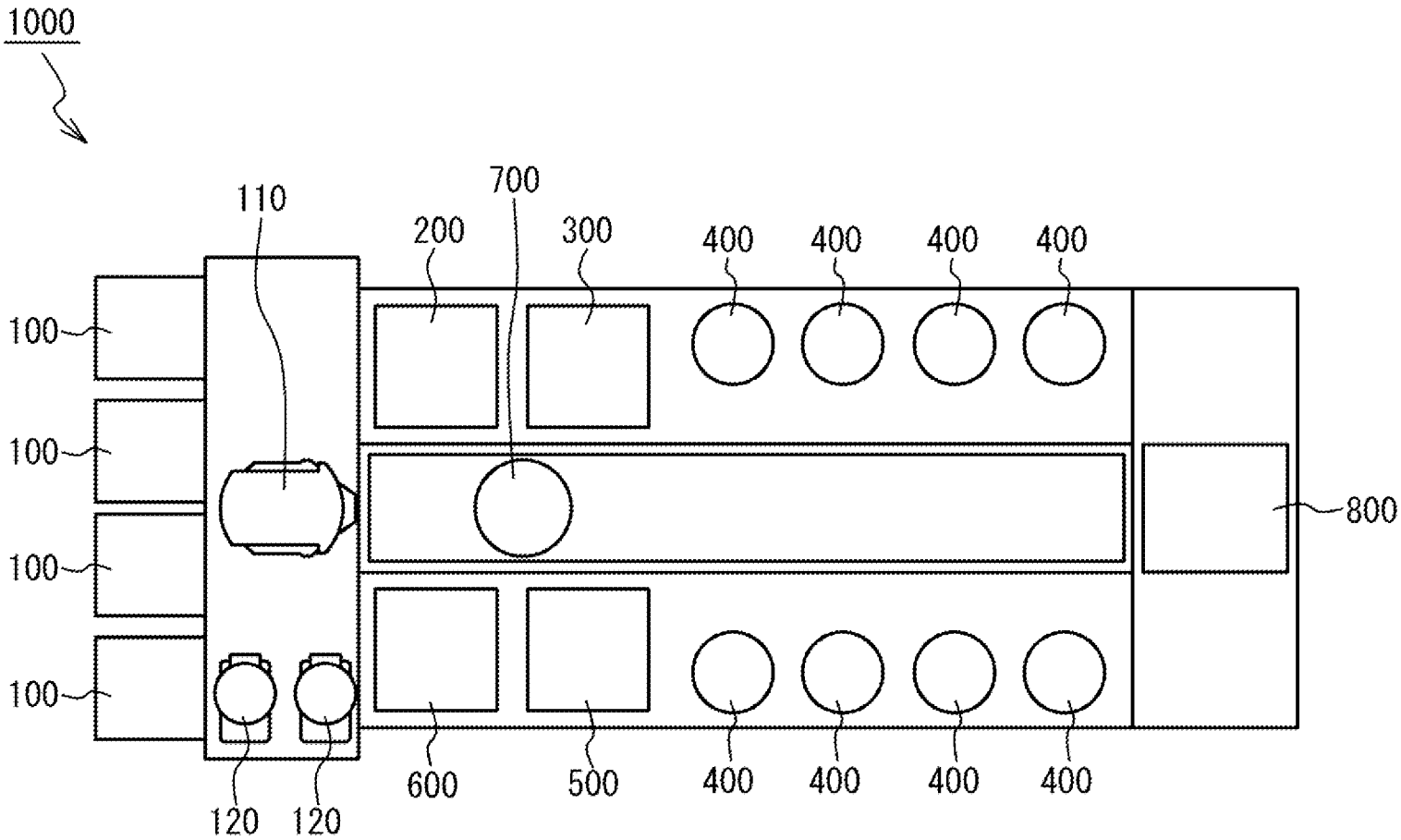
FIG. 2 is a plan view illustrating the overall configuration of the plating apparatus of this embodiment.

FIG. 1 is a perspective view illustrating the overall configuration of the plating apparatus 1000 of this embodiment. FIG. 2 is a plan view (top view) illustrating the overall configuration of the plating apparatus 1000 of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP. (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Next, the plating modules 400 will be described. Since the plurality of plating modules 400 included in the plating apparatus 1000 according to this embodiment have the identical configuration, only one of the plating modules 400 will be described.

Figure 3:
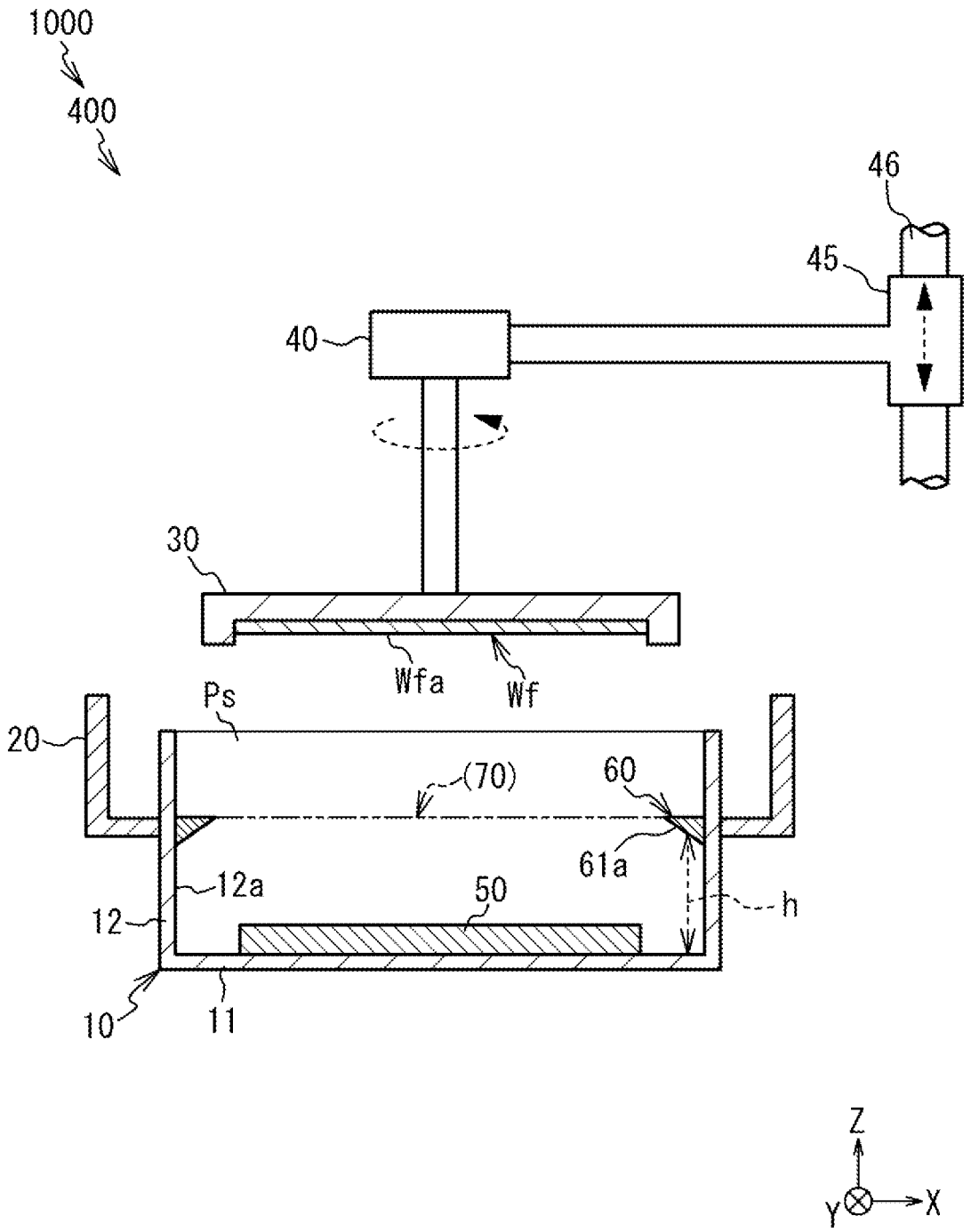
FIG. 3 is a schematic cross-sectional view illustrating a configuration of one plating module in the plating apparatus of this embodiment.

FIG. 3 is a schematic cross-sectional view illustrating a configuration of the one plating module 400 in the plating apparatus 1000 of this embodiment. The plating apparatus 1000 according to this embodiment is a cup type plating apparatus. The plating module 400 of the plating apparatus 1000 includes a plating tank 10, an overflow tank 20, a substrate holder 30, a rotation mechanism 40, and an elevating mechanism 45.

The plating tank 10 according to this embodiment is configured of a container with a bottom having an opening on an upper side. Specifically, the plating tank 10 has a bottom portion 11 and an outer peripheral portion 12 (in other words, an outer peripheral side wall portion) extending upward from an outer peripheral edge of the bottom portion 11, and an upper portion of the outer peripheral portion 12 is open. Note that, although the shape of the outer peripheral portion 12 of the plating tank 10 is not particularly limited, the outer peripheral portion 12 according to this embodiment has a cylindrical shape as an example. In an inside of the plating tank 10, a plating solution Ps is accumulated.

It is only necessary for the plating solution Ps to be a solution including an ion of a metallic element constituting a plating film, and its specific example is not particularly limited. In this embodiment, a copper plating process is used as an example of the plating process, and a copper sulfate solution is used as an example of the plating solution Ps.

In the inside of the plating tank 10, an anode 50 is arranged. Specifically, the anode 50 according to this embodiment is arranged on the bottom portion 11 of the plating tank 10. Further, the anode 50 according to this embodiment is arranged so as to extend in a horizontal direction.

The specific type of the anode 50 is not particularly limited, and the anode 50 may be an insoluble anode or may be a soluble anode. In this embodiment, the insoluble anode is used as an example of the anode 50. The specific type of the insoluble anode is not particularly limited, and platinum, iridium oxide, and the like can be used.

The overflow tank 20 is configured of a container with a bottom arranged outside the plating tank 10. The overflow tank 20 is a tank disposed for temporarily accumulating the plating solution Ps exceeding an upper end of the outer peripheral portion 12 of the plating tank 10 (that is, the plating solution Ps overflowing from the plating tank 10). The plating solution Ps temporarily accumulated in the overflow tank 20 is discharged from a discharge port (not illustrated) for the overflow tank 20, and afterwards, is circulated to the plating tank 10 again.

The substrate holder 30 holds a substrate Wf as a cathode such that a surface to be plated Wfa of the substrate Wf is opposed to the anode 50. In other words, the substrate holder 30 holds the substrate Wf such that the surface to be plated Wfa of the substrate Wf faces downward. The rotation mechanism 40 is coupled to the substrate holder 30. The rotation mechanism 40 is a mechanism for rotating the substrate holder 30. Further, the elevating mechanism 45 is coupled to the rotation mechanism 40. The elevating mechanism 45 is supported by a support pillar 46 extending in a vertical direction (Z-axis direction). The elevating mechanism 45 is a mechanism for moving up and down the substrate holder 30 and the rotation mechanism 40 in the vertical direction. Note that the substrate Wf and the anode 50 are electrically connected to an energization device (not illustrated). The energization device is a device for flowing a current between the substrate Wf and the anode 50 when the plating process is performed.

Further, the plating apparatus 1000 includes an electric field shielding plate 60 between the anode 50 and the substrate Wf in the inside of the plating tank 10. The electric field shielding plate 60 has a function to shield a part of an electric field formed between the anode 50 and the substrate Wf Although the specific material of the electric field shielding plate 60 is not particularly limited, to give a specific example, a resin, such as polyetheretherketone or polyvinyl chloride, can be used. Thus, by the plating apparatus 1000 including the electric field shielding plate 60, thickening of a film thickness of an outer peripheral portion of a plating film by a terminal effect can be suppressed. Details of the electric field shielding plate 60 will be described below.

When the plating process is performed, first, the rotation mechanism 40 rotates the substrate holder 30 while the elevating mechanism 45 moves the substrate holder 30 downward to immerse the substrate Wf in the plating solution Ps in the plating tank 10. Next, a current flows between the anode 50 and the substrate Wf by the energization device. This causes the plating film to be formed on the surface to be plated Wfa of the substrate Wf.

Figure 4A:
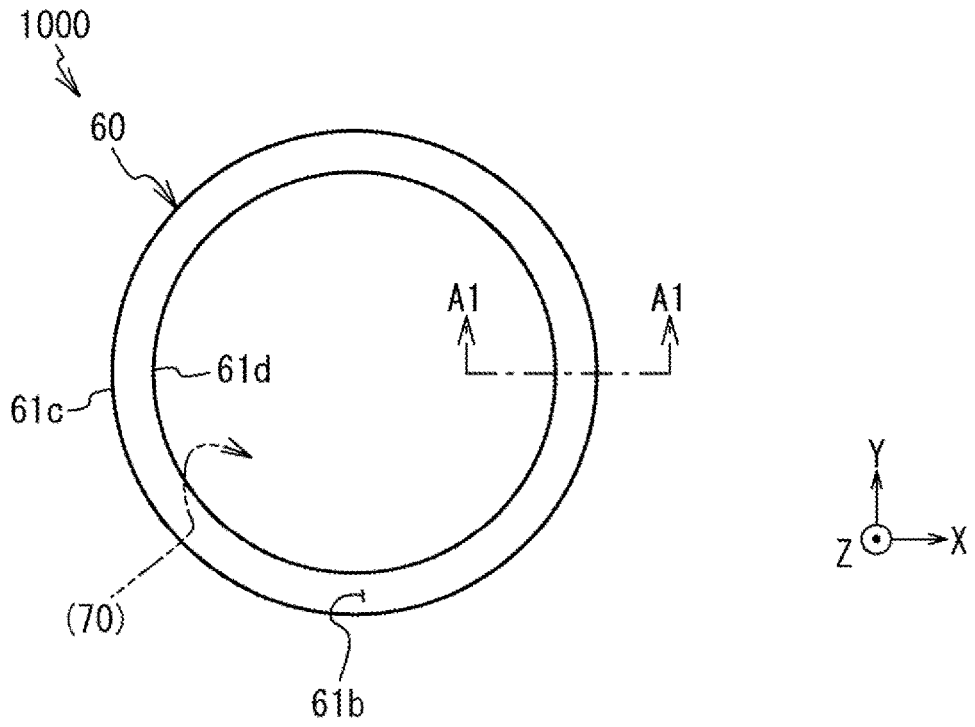
FIG. 4A is a schematic top view of an electric field shielding plate of this embodiment.
Figure 4B:
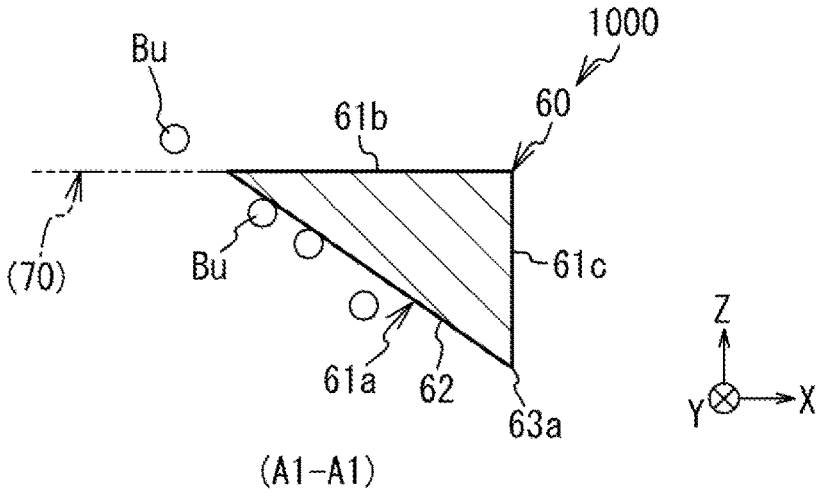
FIG. 4B is a schematic cross-sectional view of the electric field shielding plate of this embodiment cut by a cut surface in a radial direction.

Incidentally, air bubbles Bu (this numeral is illustrated in FIG. 4B described below) may be included inside the plating solution Ps. Specifically, these air bubbles Bu are the air bubbles Bu included in the plating solution Ps when the plating solution Ps is supplied in the plating tank 10, or the oxygen bubbles Bu generated from the anode 50 while the plating process is performed. Provisionally, when the air bubbles Bu included in the plating solution Ps remain on a lower surface 61*a* of the electric field shielding plate 60, the function of the electric field shielding plate 60 is possibly inhibited and plating quality of the substrate Wf possibly gets worse. Therefore, in order to solve this problem, the plating apparatus 1000 according to this embodiment includes a configuration described below.

FIG. 4A is a schematic top view of the electric field shielding plate 60. With reference to FIG. 3 and FIG. 4A, the electric field shielding plate 60 is arranged so as to extend from the outer peripheral portion 12 of the plating tank 10 toward the center side in a radial direction of the plating tank 10. Further, as an example, the electric field shielding plate 60 according to this embodiment is connected to a whole in a circumferential direction of the outer peripheral portion 12 of the plating tank 10 and has a ring shape in the top view. Specifically, the electric field shielding plate 60 has an outer peripheral surface 61*c* (outer peripheral surface 61*c* having a circular shape in the top view) connected to the whole in the circumferential direction of an inner circumference surface 12*a* on the outer peripheral portion 12 of the plating tank 10. Further, the electric field shielding plate 60 according to this embodiment has an inner peripheral portion 61*d* having a circular shape in the top view.

Note that the above-described configuration is one example of the electric field shielding plate 60, and the electric field shielding plate 60 does not necessarily have to be connected to the whole in the circumferential direction of the outer peripheral portion 12 of the plating tank 10. For example, the electric field shielding plate 60 may be connected to a part in the circumferential direction of the outer peripheral portion 12 of the plating tank 10 (or connected intermittently to the circumferential direction of the outer peripheral portion 12) and have a non-ring shape in the top view.

Further, in the top view of the inside of the plating tank 10 viewed from above the electric field shielding plate 60, in the inside of the plating tank 10, an unshielded region 70 that is a region without shielded by the electric field shielding plate 60 is disposed. In this embodiment, the region inside the electric field shielding plate 60 having the ring shape is the unshielded region 70.

FIG. 4B is a schematic cross-sectional view of the electric field shielding plate 60 cut by a "cut surface in the radial direction" extending in the vertical direction while extending in the radial direction of the plating tank 10. Specifically. FIG. 4B schematically illustrates a cross section taken along the line A1-A1 of FIG. 4A. The electric field shielding plate 60 has at least one inclined surface 62 inclined with respect to the horizontal direction (X-Y direction) disposed on the lower surface 61*a*. As an example, only one inclined surface 62 according to this embodiment is disposed. Specifically, the electric field shielding plate 60 according to this embodiment has the lower surface 61*a* entirely constituting the inclined surface 62.

The inclined surface 62 is configured to release the air bubbles Bu existing on the lower surface 61*a* of the electric field shielding plate 60 to the unshielded region 70. Specifically, the inclined surface 62 according to this embodiment inclines such that a distance (h) from the bottom portion 11 of the plating tank 10 increases as approaching the center side (center side in the radial direction) of the plating tank 10. In other words, the inclined surface 62 according to this embodiment inclines from a portion (apex 63*a*) positioned at the most downward side on the lower surface 61*a* of the electric field shielding plate 60 toward the unshielded region 70.

Further, the electric field shielding plate 60 according to this embodiment has an upper surface 61*b* being a horizontal surface. This causes the electric field shielding plate 60 according to this embodiment to have a cross-sectional shape in which a thickness becomes thinner as approaching the center side of the plating tank 10. Further, the electric field shielding plate 60 according to this embodiment exhibits a triangular shape formed by the upper surface 61*b*, the lower surface 61*a* (inclined surface 62), and the outer peripheral surface 61*c* of the electric field shielding plate 60 in the cross-sectional view cut by the cut surface in the radial direction.

With this embodiment as described above, the air bubbles Bu existing on the lower surface 61*a* of the electric field shielding plate 60 can be effectively released to the unshielded region 70 by the inclined surface 62. This can suppress remaining of the air bubbles Bu on the lower surface 61*a* of the electric field shielding plate 60. Consequently, inhibiting the function of the electric field shielding plate 60 due to the air bubbles Bu remaining on the lower surface 61*a* of the electric field shielding plate 60 can be suppressed. This can suppress the plating quality of the substrate Wf getting worse.

Note that the above-described electric field shielding plate 60 is an example. It is only necessary for the electric field shielding plate to have an inclined surface configured to release air bubbles existing on a lower surface of the electric field shielding plate to an unshielded region, and the electric field shielding plate is not limited to the above-described example. Further, it is only necessary for the plating apparatus to include the electric field shielding plate having such an inclined surface, and the plating apparatus is not limited to the above-described example. Therefore, various kinds of modifications of the electric field shielding plate and the plating apparatus will be described below. Note that these modifications are also merely examples, and the configurations of the electric field shielding plate and the plating apparatus are not limited to these modifications.

[Modification 1]

Figure 5:
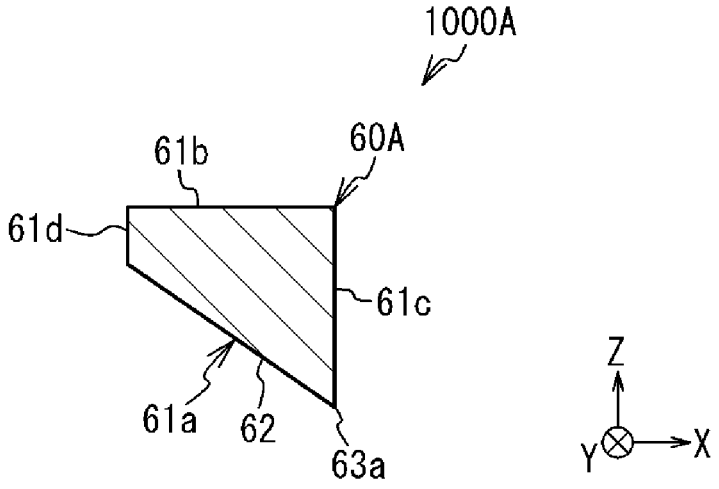
FIG. 5 is a schematic cross-sectional view of an electric field shielding plate of a plating apparatus according to a modification 1 of this embodiment.

FIG. 5 is a schematic cross-sectional view of an electric field shielding plate 60A of a plating apparatus 1000A according to a modification 1 of this embodiment. Specifically. FIG. 5 schematically illustrates a cross section of the electric field shielding plate 60A according to this modification cut by a cut surface in the radial direction, and more specifically. FIG. 5 schematically illustrates a cross section taken along the line A1-A1, similarly to FIG. 4B.

The electric field shielding plate 60A according to this modification exhibits a trapezoidal shape in the cross-sectional view because an end portion on an upward side of the inclined surface 62 is not connected to an end portion of the center side of the upper surface 61*b*. Consequently, the inner peripheral portion 61*d* of the electric field shielding plate 60A is not a line but a surface (that is, an inner peripheral surface). Even in this modification, since the electric field shielding plate 60A has the inclined surface 62, the operational advantage similar to the above-described plating apparatus 1000 can be provided.

[Modification 2]

Figure 6:
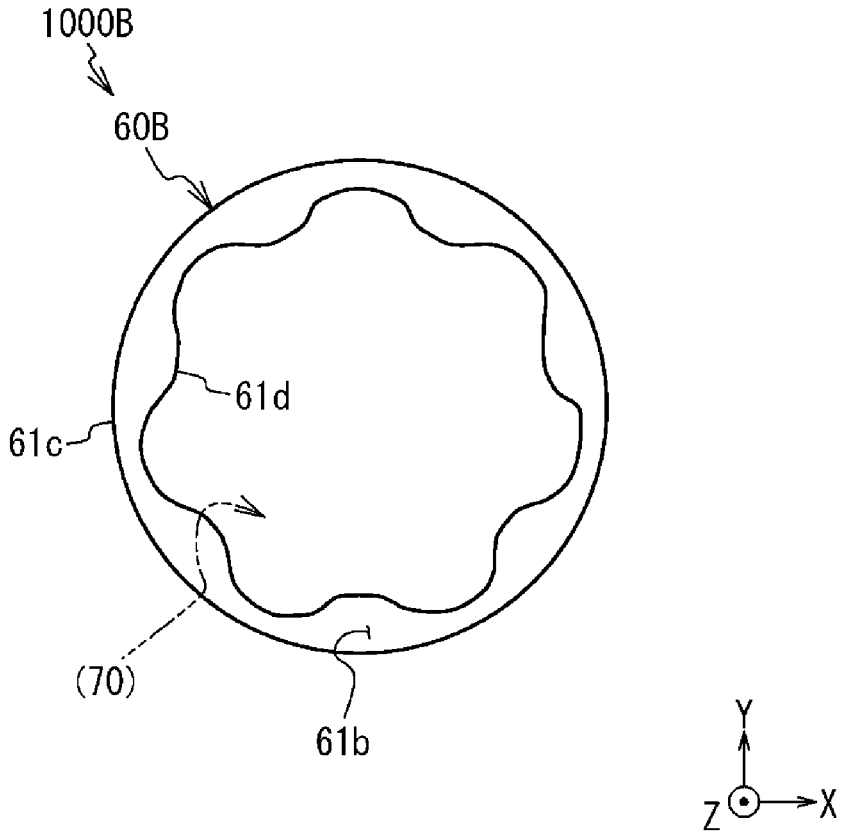
FIG. 6 is a schematic top view of an electric field shielding plate of a plating apparatus according to a modification 2 of this embodiment.

FIG. 6 is a schematic top view of an electric field shielding plate 60B of a plating apparatus 1000B according to a modification 2 of this embodiment. Although the electric field shielding plate 60B according to this modification is similar to the electric field shielding plate 60 illustrated in FIG. 4A in the point of having a ring shape in the top view, the electric field shielding plate 60B is different from the electric field shielding plate 60 in the point that the inner peripheral portion 61*d* of the electric field shielding plate 60B does not have a circular shape but a trochoid shape. Even in this modification, since the electric field shielding plate 60B has the inclined surface 62, the operational advantage similar to the above-described plating apparatus 1000 can be provided.

Note that the electric field shielding plate 60B according to this modification may further include the features according to the above-described modification 1.

[Modification 3]

Figure 7A:
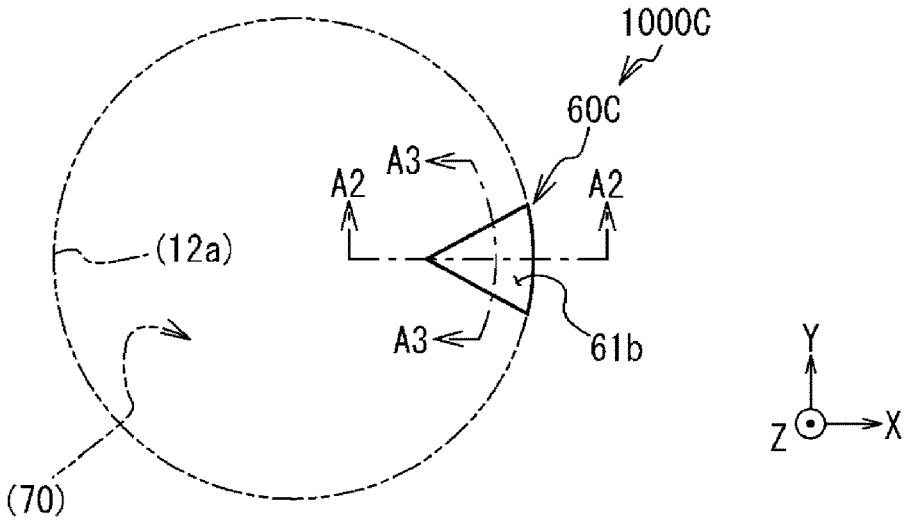
FIG. 7A is a schematic top view of an electric field shielding plate of a plating apparatus according to a modification 3 of this embodiment.

FIG. 7A is a schematic top view of an electric field shielding plate 60C of a plating apparatus 1000C according to a modification 3 of this embodiment. The electric field shielding plate 60C according to this modification is different from the electric field shielding plate 60 illustrated in FIG. 4A in the point that the electric field shielding plate 60C is connected to a part in the circumferential direction of the inner circumference surface 12*a* of the outer peripheral portion 12 of the plating tank 10 and has a non-ring shape in the top view of the electric field shielding plate 60C.

Although specific examples of the non-ring shape of the electric field shielding plate 60C are not particularly limited, in this modification, the non-ring shape is a circular sector shape as an example. That is, the electric field shielding plate 60C is configured to shield only a certain direction in the top view. Note that the center of this circular sector does not reach the center of the plating tank 10 in this modification.

Figure 7B:
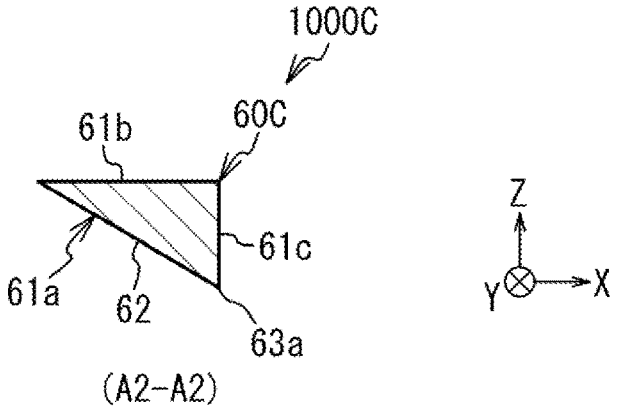
FIG. 7B is a schematic cross-sectional view of the electric field shielding plate according to the modification 3 of this embodiment cut by a cut surface in a radial direction.

FIG. 7B is a schematic cross-sectional view of the electric field shielding plate 60C cut by a cut surface in the radial direction. Specifically, FIG. 7B schematically illustrates a cross section taken along the line A2-A2 of FIG. 7A. The inclined surface 62 of the electric field shielding plate 60C has a configuration similar to the inclined surface 62 in the above-described FIG. 4B. Therefore, the description of the inclined surface 62 of the electric field shielding plate 60C will be omitted.

Figure 7C:
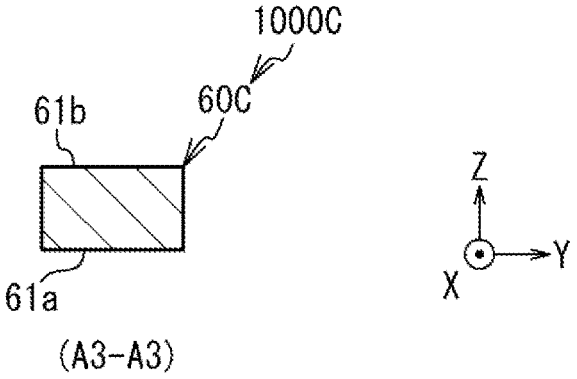
FIG. 7C is a schematic cross-sectional view of the electric field shielding plate according to the modification 3 of this embodiment cut by a cut surface in a circumferential direction.

FIG. 7C is a schematic cross-sectional view of the electric field shielding plate 60C cut by a "cut surface in the circumferential direction" extending in the circumferential direction of the plating tank 10 while extending in the vertical direction. Specifically, FIG. 7C schematically illustrates a cross section taken along the line A3-A3 of FIG. 7A. The electric field shielding plate 60C according to this modification has the lower surface 61*a* becoming horizontal without inclining toward the circumferential direction.

Even in this modification, since the electric field shielding plate 60C has the inclined surface 62, the operational advantage similar to the above-described plating apparatus 1000 can be provided.

[Modification 4]

Figure 8A:
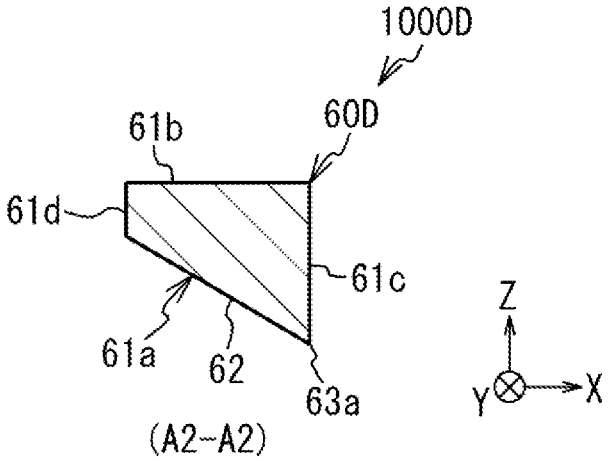
FIG. 8A is a schematic cross-sectional view of an electric field shielding plate of a plating apparatus according to a modification 4 of this embodiment.

FIG. 8A is a schematic cross-sectional view of an electric field shielding plate 60D of a plating apparatus 1000D according to a modification 4 of this embodiment. Specifically. FIG. 8A schematically illustrates a cross section of the electric field shielding plate 60D according to this modification cut by a cut surface in the radial direction, and more specifically, FIG. 8A schematically illustrates a cross-section taken along the line A2-A2, similarly to FIG. 7B.

The electric field shielding plate 60D according to this modification exhibits a trapezoidal shape in the cross-sectional view because the end portion on the upward side of the inclined surface 62 is not connected to the end portion of the center side of the upper surface 61*b*, similarly to the electric field shielding plate 60A according to the modification 1 described in FIG. 5. Consequently, the inner peripheral portion 61*d* of the electric field shielding plate 60D is not a line but a surface (inner peripheral surface). Even in this modification, the operational advantage similar to the plating apparatus 1000C according to the above-described modification 3 can be provided.

[Modification 5]

Figure 8B:
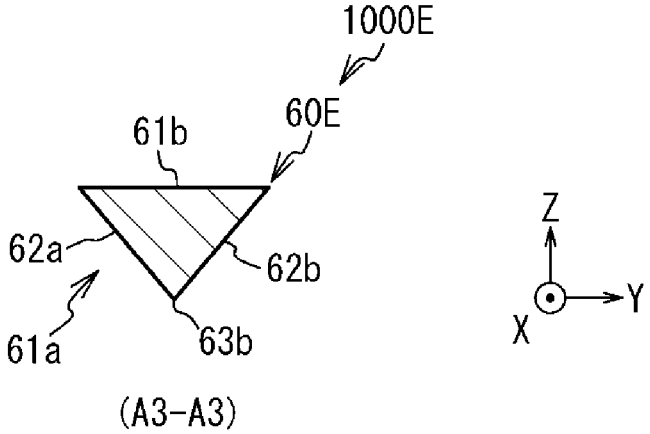
FIG. 8B is a schematic cross-sectional view of an electric field shielding plate of a plating apparatus according to a modification 5 of this embodiment.

FIG. 8B is a schematic cross-sectional view of an electric field shielding plate 60E of a plating apparatus 1000E according to a modification 5 of this embodiment. Specifically, FIG. 8B schematically illustrates a cross section of the electric field shielding plate 60E cut by a cut surface in the circumferential direction, and more specifically, FIG. 8B schematically illustrates a cross section taken along the line A3-A3.

The electric field shielding plate 60E according to this modification is different from the electric field shielding plate 60C and the electric field shielding plate 60D in the point that an inclined surface 62*a* and an inclined surface 62*b* are disposed on the lower surface 61*a*.

Note that, although an illustration is omitted, the electric field shielding plate 60E according to this modification has the lower surface 61*a* inclining as illustrated in FIG. 7B and FIG. 8A. However, the electric field shielding plate 60E is not limited to this configuration, and the electric field shielding plate 60E may have the lower surface 61*a* being horizontal in the cross-sectional view cut by the cut surface in the radial direction, similarly to FIG. 7C.

The inclined surface 62*a* and the inclined surface 62*b* are inclined surfaces that incline with respect to the horizontal direction and are configured to release the air bubbles Bu existing on the lower surface 61*a* of the electric field shielding plate 60E to the unshielded region 70. Specifically, in the cross-sectional view cut by the cut surface in the circumferential direction, the inclined surface 62*a* and the inclined surface 62*b* incline so as to extend from a portion (apex 63*b*) positioned at the most downward side on the lower surface 61*a* of the electric field shielding plate 60E toward the unshielded region 70.

More specifically, the inclined surface 62*a* inclines such that the distance (h) from the bottom portion 11 of the plating tank 10 increases as approaching from the apex 63*b* toward "one side in the circumferential direction". On the other hand, the inclined surface 62*b* inclines such that the distance (h) from the bottom portion 11 of the plating tank 10 increases as approaching from the apex 63*b* toward "the other side in the circumferential direction".

With this modification, since the electric field shielding plate 60E has the inclined surface 62*a* and the inclined surface 62*b*, the air bubbles Bu existing on the lower surface 61*a* of the electric field shielding plate 60E can be effectively released to the unshielded region 70 by the inclined surface 62*a* and the inclined surface 62*b*.

Note that, in this modification, the electric field shielding plate 60E may include only either one of the inclined surface 62*a* and the inclined surface 62*b*.

[Modification 6]

Figure 8C:
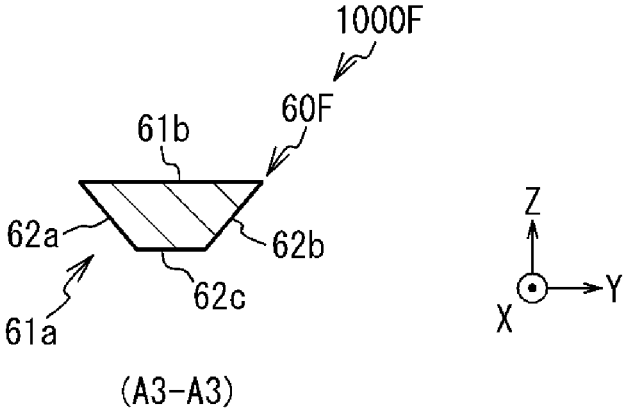
FIG. 8C is a schematic cross-sectional view of an electric field shielding plate of a plating apparatus according to a modification 6 of this embodiment.

FIG. 8C is a schematic cross-sectional view of an electric field shielding plate 60F of a plating apparatus 1000F according to a modification 6 of this embodiment. Specifically, FIG. 8C schematically illustrates a cross section of the electric field shielding plate 60F cut by a cut surface in the circumferential direction, and more specifically. FIG. 8C schematically illustrates a cross section taken along the line A3-A3.

The electric field shielding plate 60F according to this modification is different from the electric field shielding plate 60E illustrated in FIG. 8B in the point that an inclined surface 62*c* is further included. Although the inclined surface 62*c* does not incline in the cross-sectional view (FIG. 8C) cut by the cut surface in the circumferential direction, the inclined surface 62*c* inclines similarly to the inclined surface 62 in FIG. 7B and FIG. 8A in the cross-sectional view cut by the cut surface in the radial direction. That is, the inclined surface 62*c* inclines such that the distance (h) from the bottom portion 11 of the plating tank 10 increases as approaching the center side of the plating tank 10 in the cross-sectional view cut by the cut surface in the radial direction.

With this modification, since the inclined surface 62*a*, the inclined surface 62*b*, and the inclined surface 62*c* are included, the air bubbles Bu existing on the lower surface 61*a* of the electric field shielding plate 60F can be effectively released to the unshielded region 70 by the inclined surface 62*a*, the inclined surface 62*b*, and the inclined surface 62*c*.

[Modification 7]

Figure 9A:
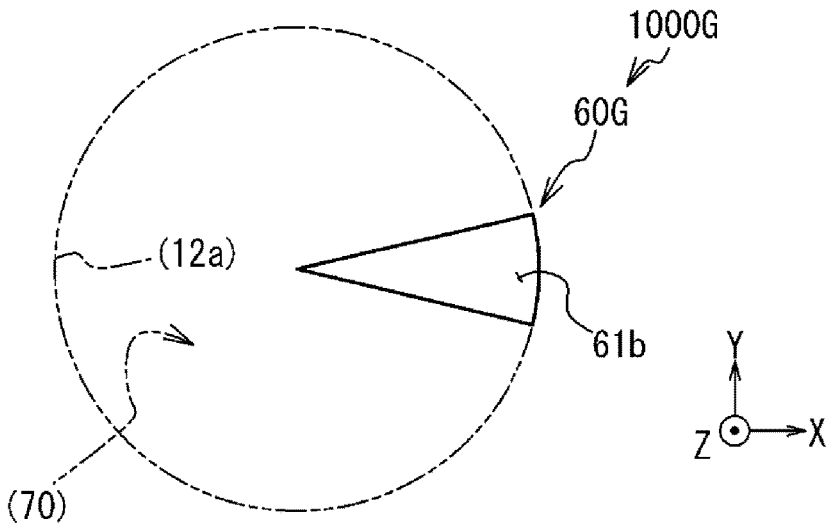
FIG. 9A is a schematic top view of an electric field shielding plate of a plating apparatus according to a modification 7 of this embodiment.

FIG. 9A is a schematic top view of an electric field shielding plate 60G of a plating apparatus 1000G according to a modification 7 of this embodiment. The electric field shielding plate 60G according to this modification is similar to the electric field shielding plate 60C illustrated in FIG. 7A in the point that the electric field shielding plate 60G has a circular sector shape in the top view. On the other hand, the electric field shielding plate 60G according to this modification is different from the electric field shielding plate 60C in the point that the center of this circular sector further extends to the center side of the plating tank 10, and specifically, the center of this circular sector reaches the center of the plating tank 10.

Even in this modification, the operational advantage similar to the plating apparatus 1000C described in FIG. 7A can be provided.

Note that the electric field shielding plate 60G according to this modification may further include the features according to the above-described modifications 4 to 6.

[Modification 8]

Figure 9B:
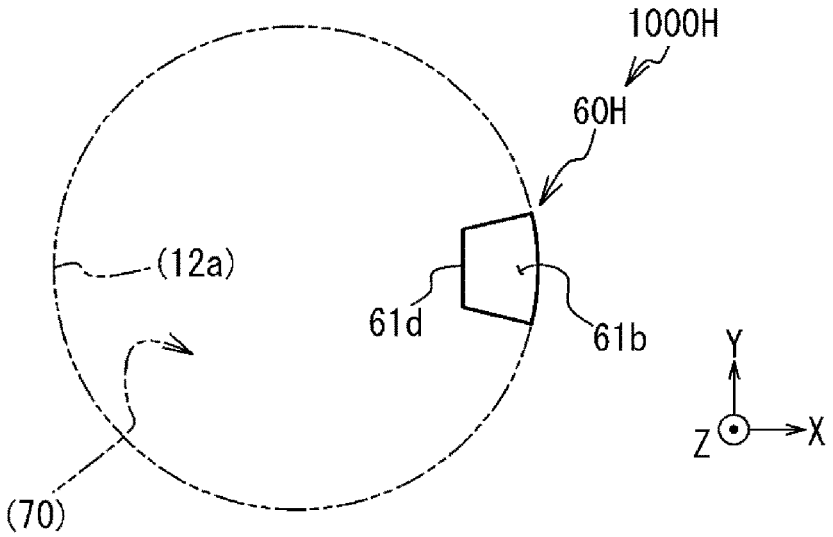
FIG. 9B is a schematic top view of an electric field shielding plate of a plating apparatus according to a modification 8 of this embodiment.

FIG. 9B is a schematic top view of an electric field shielding plate 60H of a plating apparatus 1000H according to a modification 8 of this embodiment. The electric field shielding plate 60H according to this modification is different from the electric field shielding plate 60C illustrated in FIG. 7A in the point that the inner peripheral portion 61*d* of the electric field shielding plate 60H becomes a surface extending in the vertical direction (that is, an inner peripheral surface). That is, the electric field shielding plate 60H according to this modification has a truncated circular sector (circular sector with the apex cut off) shape in the top view. Note that this inner peripheral portion 61*d* may be a planar surface (non-curved surface) or may be a curved surface (for example, cylindrically-shaped curved surface).

Even in this modification, the operational advantage similar to the plating apparatus 1000C described in FIG. 7A can be provided.

Note that the electric field shielding plate 60H according to this modification may further include the features according to the above-described modifications 4 to 6.

[Modification 9]

Figure 10:
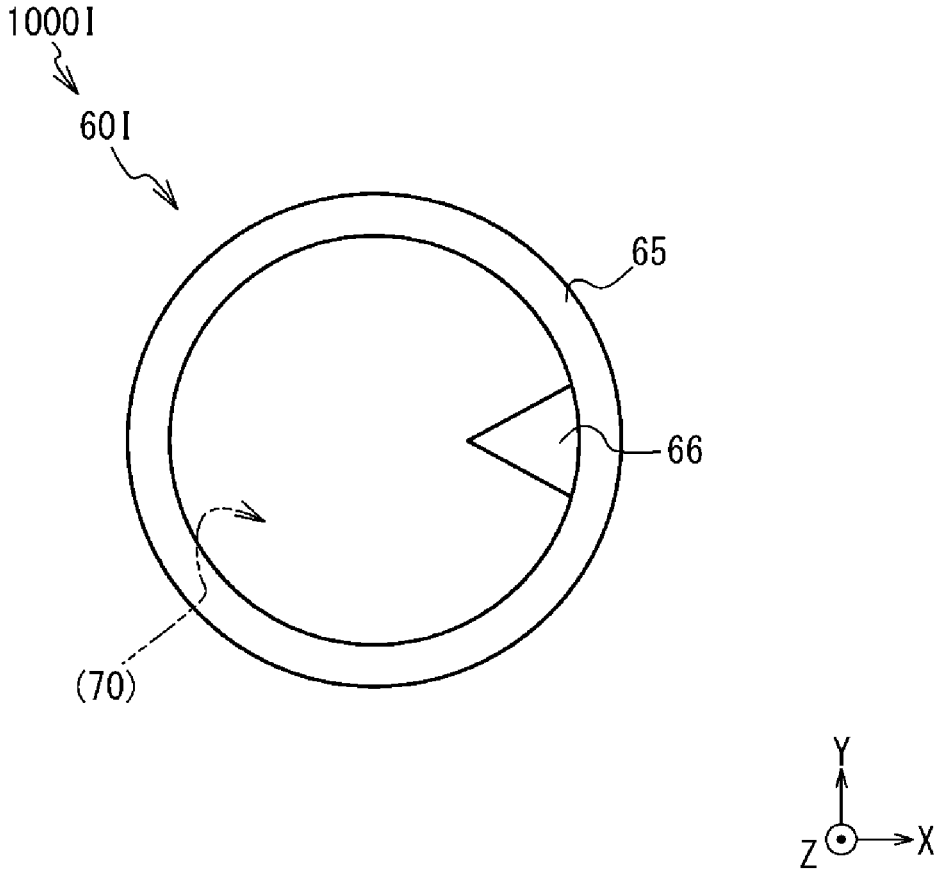
FIG. 10 is a schematic top view of an electric field shielding plate of a plating apparatus according to a modification 9 of this embodiment.

FIG. 10 is a schematic top view of an electric field shielding plate 60I of a plating apparatus 1000I according to a modification 9 of this embodiment. The electric field shielding plate 60I according to this modification is different from the above-described embodiment and modifications in the point that a ring-shaped portion 65 and a non-ring-shaped portion 66 are included. The ring-shaped portion 65 is a portion that is connected to a whole in the circumferential direction of the outer peripheral portion 12 of the plating tank 10 and has a ring shape in the top view of the electric field shielding plate 60I. The non-ring-shaped portion 66 is a portion that is connected to a part in the circumferential direction of the ring-shaped portion 65 and has a non-ring shape in the top view.

Specifically, the ring-shaped portion 65 according to this modification has a shape similar to the electric field shielding plate 60 illustrated in FIG. 4A. Further, the non-ring-shaped portion 66 according to this modification has a shape similar to the electric field shielding plate 60C illustrated in FIG. 7A. That is, the electric field shielding plate 60I according to this modification is configured by a combination of the electric field shielding plate 60 and the electric field shielding plate 60C.

Note that the specific method for producing the electric field shielding plate 60I is not particularly limited, and for example, after the ring-shaped portion 65 and the non-ring-shaped portion 66 are separately produced, both may be joined. Alternatively, by scraping the electric field shielding plate 60I off from a member in a bulk shape, the electric field shielding plate 60I having the ring-shaped portion 65 and the non-ring-shaped portion 66 may be integrally produced. Alternatively, by plastic working such as injection molding, the electric field shielding plate 60I having the ring-shaped portion 65 and the non-ring-shaped portion 66 may be integrally produced.

With this modification, the air bubbles Bu existing on the lower surface 61*a* of the electric field shielding plate 60I can be effectively released to the unshielded region 70 by the inclined surface 62 of the ring-shaped portion 65 and the inclined surface 62 of the non-ring-shaped portion 66.

Note that the ring-shaped portion 65 of the electric field shielding plate 60I according to this modification may further include the features according to the modification 1 or the modification 2. Further, the non-ring-shaped portion 66 may further include the features according to the modifications 4 to 8.

Further, in the above-described modification, although both the ring-shaped portion 65 and the non-ring-shaped portion 66 include the inclined surface 62, this modification is not limited to this configuration. For example, only either one of the ring-shaped portion 65 and the non-ring-shaped portion 66 may include the inclined surface 62.

[Modification 10]

Figure 11:
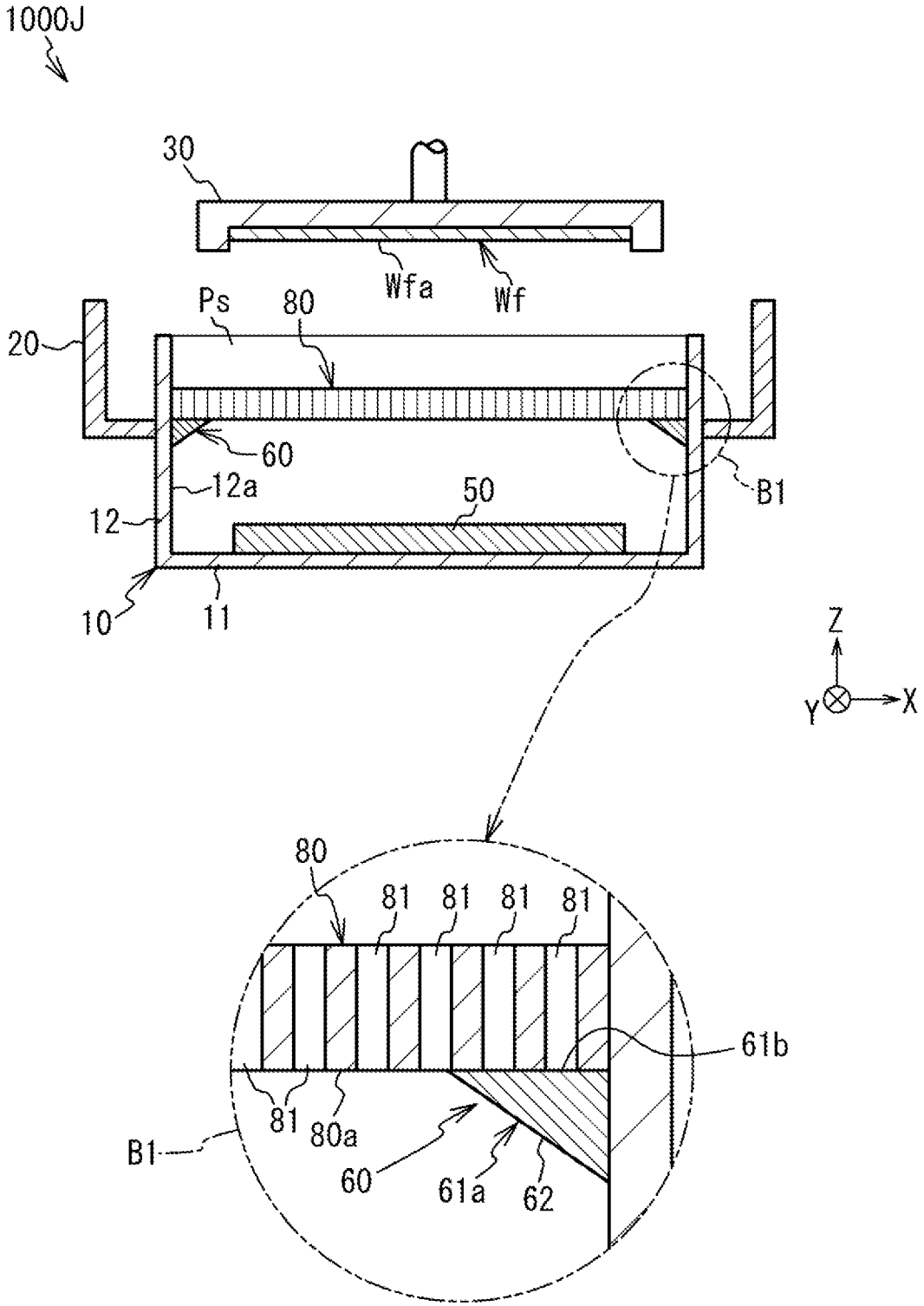
FIG. 11 is a schematic cross-sectional view illustrating a peripheral configuration of a plating tank of a plating apparatus according to a modification 10 of this embodiment.

FIG. 11 is a schematic cross-sectional view illustrating a peripheral configuration of the plating tank 10 of a plating apparatus 1000J according to a modification 10 of this embodiment. Note that, in FIG. 11, illustrations of the rotation mechanism 40, the elevating mechanism 45, the support pillar 46, and the like are omitted. The plating apparatus 1000J according to this modification is different from the plating apparatus 1000 described in FIG. 3 in the point that an ionically resistive element 80 is further included.

The ionically resistive element 80 is arranged between the anode 50 and the substrate Wf in the inside of the plating tank 10. Specifically, the ionically resistive element 80 according to this modification is arranged above the electric field shielding plate 60 and below the substrate Wf. Consequently, the electric field shielding plate 60 according to this modification is arranged on the downward side with respect to the ionically resistive element 80. Specifically, the electric field shielding plate 60 according to this modification is arranged such that the upper surface 61*b* of the electric field shielding plate 60 is connected to a lower surface 80*a* of the ionically resistive element 80.

Note that, the specific method for producing the electric field shielding plate 60 is not particularly limited, and for example, the following method can be used. For example, after the ionically resistive element 80 and the electric field shielding plate 60 are separately produced, both may be joined. Alternatively, by scraping the ionically resistive element 80 and electric field shielding plate 60 off from a member in a bulk shape, the ionically resistive element 80 and the electric field shielding plate 60 may be integrally produced (that is, the integrally connected ionically resistive element 80 and electric field shielding plate 60 may be produced). Alternatively, by plastic working such as injection molding, the ionically resistive element 80 and the electric field shielding plate 60 may be integrally produced.

Note that, by the electric field shielding plate 60 and the ionically resistive element 80 being integrally produced as described above (that is, the electric field shielding plate 60 being integrated with the ionically resistive element 80), the following advantages can be obtained as compared with the case where the electric field shielding plate 60 and the ionically resistive element 80 are separately produced. Specifically, with the electric field shielding plate 60 and the ionically resistive element 80 integrated, installation of the ionically resistive element 80 to the plating tank 10 simultaneously completes installation of the electric field shielding plate 60 to the plating tank 10 and ensures a determined installation position of the electric field shielding plate 60 inside the plating tank 10. Consequently, the need for labor to adjust a positional relationship between the electric field shielding plate 60 and the ionically resistive element 80 is eliminated after the installation of the electric field shielding plate 60 to the plating tank 10. Thus, by the electric field shielding plate 60 and the ionically resistive element 80 being integrated, the installation of the electric field shielding plate 60 to the plating tank 10 can be facilitated.

Further, the ionically resistive element 80 according to this modification is arranged so as to be parallel to the anode 50. Further, the ionically resistive element 80 according to this modification is connected to the whole in the circumferential direction of the outer peripheral portion 12 of the plating tank 10 and has a circular plate shape in the top view.

This ionically resistive element 80 is configured by a porous member having a plurality of holes 81. Specifically, the holes 81 according to this modification are formed so as to communicate a region above the ionically resistive element 80 with a region below the ionically resistive element 80. Note that, although the specific material of the ionically resistive element 80 is not particularly limited, a resin, such as polyetheretherketone, is used as an example in this modification.

Further, the electric field shielding plate 60 according to this modification is connected to the lower surface 80*a* of the ionically resistive element 80 such that the upper surface 61*b* of the electric field shielding plate 60 shields the holes 81 existing in a region near an outer peripheral portion of the ionically resistive element 80 (region reaching from an outer peripheral portion to the center side for a predetermined distance).

Note that, although the electric field shielding plate 60 according to this modification is connected to a whole in the circumferential direction of an outer peripheral edge of the ionically resistive element 80 (specifically, an outer peripheral edge of the lower surface 80*a* of the ionically resistive element 80) and has a ring shape in the top view, the electric field shielding plate 60 is not necessarily limited to this configuration. For example, the electric field shielding plate 60 according to this modification may be connected to a part in the circumferential direction of the outer peripheral edge of the ionically resistive element 80 (or connected intermittently to the circumferential direction of the outer peripheral edge) and have a non-ring shape in the top view.

With this modification, since the ionically resistive element 80 is included, the ionically resistive element 80 becomes resistance of the electric field generated between the anode 50 and the substrate Wf when the plating process is performed and can ensure homogenization of the electric field within a surface of the substrate Wf. This can ensure homogenization of the film thickness of the plating film.

Further, even in this modification, since the electric field shielding plate 60 has the inclined surface 62 similarly to the plating apparatus 1000 according to this embodiment, the operational advantage similar to the plating apparatus 1000 according to this embodiment can be provided.

Note that the plating apparatus 1000J according to this modification may include the features according to the modifications 1 to 9. In other words, the plating apparatus according to the modifications 1 to 9 may include the features according to this modification.

[Modification 11]

Figure 12A:
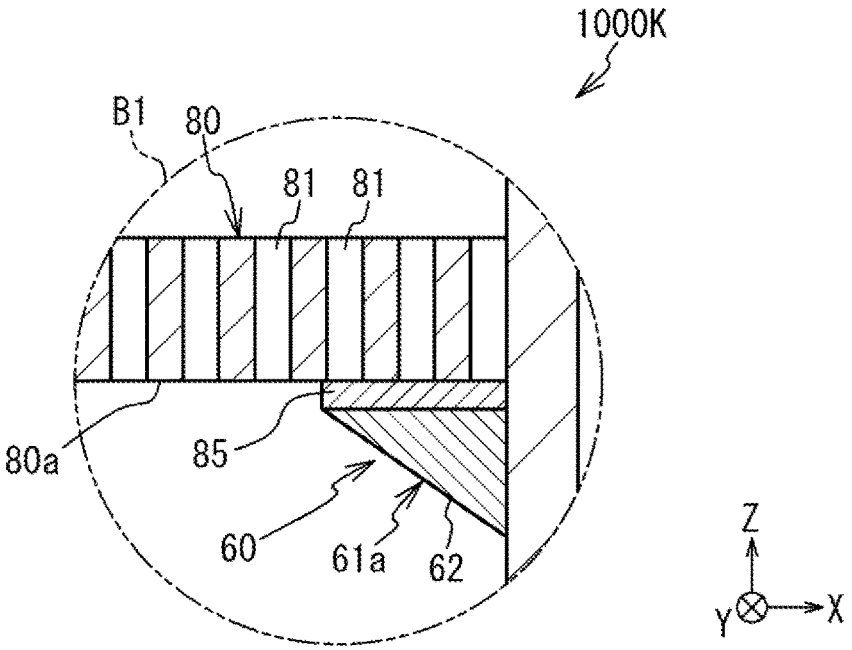
FIG. 12A is a schematic cross-sectional view illustrating an enlarged peripheral configuration of an electric field shielding plate of a plating apparatus according to a modification 11 of this embodiment.

FIG. 12A is a schematic cross-sectional view illustrating an enlarged peripheral configuration of the electric field shielding plate 60 of a plating apparatus 1000K according to a modification 11 of this embodiment. Specifically. FIG. 12A enlarges and schematically illustrates a portion corresponding to B1 in FIG. 11. The plating apparatus 1000K according to this modification is different from the plating apparatus 1000J described in FIG. 11 in the point that the upper surface 61*b* of the electric field shielding plate 60 is coupled to the lower surface 80*a* of the ionically resistive element 80 via a sealing member 85.

The sealing member 85 according to this modification is arranged on the lower surface 80*a* of the ionically resistive element 80 so as to shield the holes 81 existing in the region near the outer peripheral portion of the ionically resistive element 80.

Although the specific material of the sealing member 85 is not particularly limited as long as the material has a sealing property, in this modification, a material having a certain amount of elasticity is used. Specifically, in this modification, an elastomer is used as an example of the material of the sealing member 85.

Even in this modification, the operational advantage similar to the modification 10 can be provided.

Note that the plating apparatus 1000K according to this modification may include the features according to the modifications 1 to 9. In other words, the plating apparatus according to the modifications 1 to 9 may include the features according to this modification.

[Modification 12]

Figure 12B:
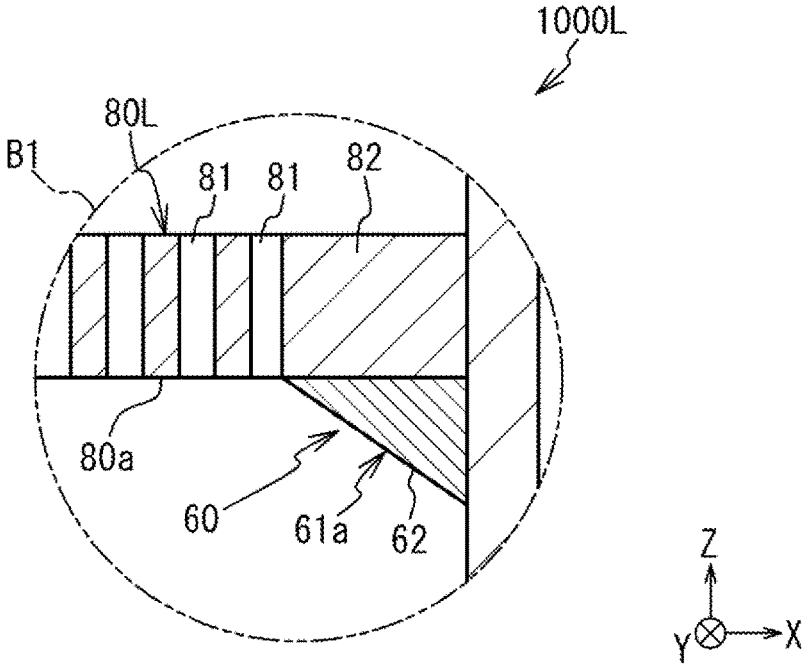
FIG. 12B is a schematic cross-sectional view illustrating an enlarged peripheral configuration of an electric field shielding plate of a plating apparatus according to a modification 12 of this embodiment.

FIG. 12B is a schematic cross-sectional view illustrating an enlarged peripheral configuration of the electric field shielding plate 60 of a plating apparatus 1000L according to a modification 12 of this embodiment. Specifically, FIG. 12B enlarges and schematically illustrates a portion corresponding to B1, similarly to FIG. 12A. The plating apparatus 1000L according to this modification includes an ionically resistive element 80L instead of the ionically resistive element 80. The ionically resistive element 80L is different from the ionically resistive element 80 according to the above-described modification 10 in the point that a portion where the holes 81 are not formed (referred to as a non-opening portion 82) is included in a region near an outer peripheral portion of the ionically resistive element 80L. The electric field shielding plate 60 according to this modification is arranged on the lower surface 80*a* of the non-opening portion 82.

Even in this modification, the operational advantage similar to the modification 10 can be provided.

Note that the plating apparatus 1000L according to this modification may include the features according to the modifications 1 to 9. In other words, the plating apparatus according to the modifications 1 to 9 may include the features according to this modification.

[Modification 13]

Figure 13:
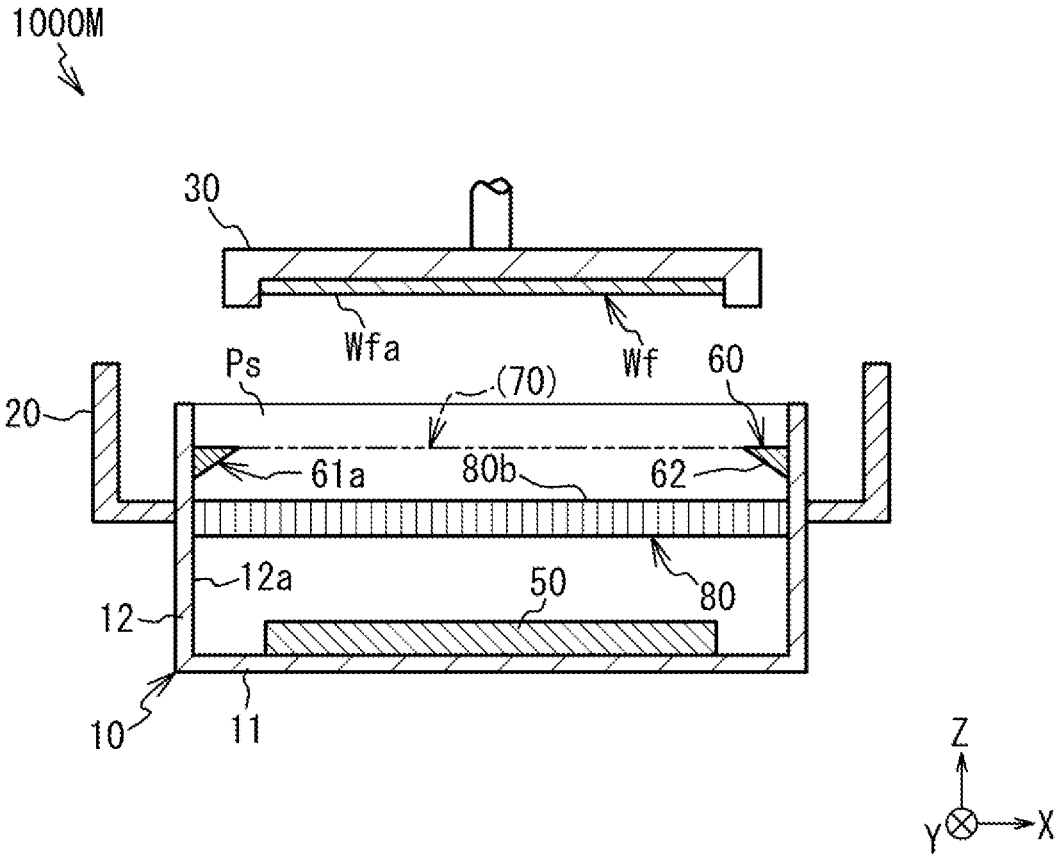
FIG. 13 is a schematic cross-sectional view illustrating a peripheral configuration of a plating tank of a plating apparatus according to a modification 13 of this embodiment.

FIG. 13 is a schematic cross-sectional view illustrating a peripheral configuration of the plating tank 10 of a plating apparatus 1000M according to a modification 13 of this embodiment. The plating apparatus 1000M is different from the plating apparatus 1000J illustrated in FIG. 11 in the point that the electric field shielding plate 60 is arranged above the ionically resistive element 80. Even in this modification, since the electric field shielding plate 60 has the inclined surface 62, the operational advantage similar to the plating apparatus 1000J according to the modification 10 can be provided.

Note that the electric field shielding plate 60 according to this modification may be connected to a whole in the circumferential direction of an outer peripheral edge of an upper surface 80*b* of the ionically resistive element 80 (in this case, the electric field shielding plate 60 has a ring shape in the top view). Alternatively, the electric field shielding plate 60 according to this modification may be connected to a part in the circumferential direction of the outer peripheral edge of the upper surface 80*b* of the ionically resistive element 80 (or connected intermittently to the circumferential direction of the outer peripheral edge) and have a non-ring shape in the top view.

Note that the plating apparatus 1000M according to this modification may include the features according to the modifications 1 to 9. In other words, the plating apparatus according to the modifications 1 to 9 may include the features according to this modification.

Although this embodiment and modifications according to the present invention have been described in detail above, the present invention is not limited to such specific embodiment and modifications, and further various kinds of variants and modifications are possible within the scope of the gist of the present invention described in the claims.

REFERENCE SIGNS LIST

10 . . . plating tank
11 . . . bottom portion
12 . . . outer peripheral portion
30 . . . substrate holder
50 . . . anode
60 . . . electric field shielding plate
61*a* . . . lower surface
62 . . . inclined surface
65 . . . ring-shaped portion
66 . . . non-ring-shaped portion
70 . . . unshielded region
80 . . . ionically resistive element
1000 . . . plating apparatus
Wf . . . substrate
Wfa . . . surface to be plated
Ps . . . plating solution
Bu . . . air bubble

What is claimed is:

1. A plating apparatus comprising:

a plating tank for accumulating a plating solution, the plating tank including an anode;

a substrate holder arranged above the anode for holding a substrate as a cathode such that a surface to be plated of the substrate is opposed to the anode; and an electric field shielding plate configured to be arranged in a portion between the anode and the substrate inside of the plating tank for shielding a part of an electric field formed between the anode and the substrate, wherein in a top view of the inside of the plating tank viewed from above the electric field shielding plate, a region without electric field shielding by the electric field shielding plate is disposed inside of the plating tank, an inclined surface is disposed in a lower surface of the electric field shielding plate, the inclined surface being inclined with respect to a horizontal direction, the inclined surface being configured to release an air bubble existing on the lower surface of the electric field shielding plate to the region without electric field shielding, the electric field shielding plate extends from an outer peripheral portion of the plating tank toward a center of the plating tank, and the electric field shielding plate is connected to a whole circumference of the outer peripheral portion of the plating tank and has a ring shape in the top view.

2. The plating apparatus according to claim 1, wherein the inclined surface inclines such that a distance from a bottom portion of the plating tank increases while approaching the center of the plating tank.

3. The plating apparatus according to claim 1, further comprising a porous ionically resistive element configured to be arranged between the anode and the substrate in the inside of the plating tank, wherein the electric field shielding plate is arranged below the ionically resistive element or above the ionically resistive element.

4. A plating apparatus comprising: a plating tank for accumulating a plating solution, the plating tank including an anode; a substrate holder arranged above the anode for holding a substrate as a cathode such that a surface to be plated of the substrate is opposed to the anode; and an electric field shielding plate configured to be arranged in a portion between the anode and the substrate inside of the plating tank for shielding a part of an electric field formed between the anode and the substrate, wherein in a top view of the inside of the plating tank viewed from above the electric field shielding plate, a region without electric field shielding by the electric field shielding plate is disposed inside of the plating tank, an inclined surface is disposed in a lower surface of the electric field shielding plate, the inclined surface being inclined with respect to a horizontal direction, the inclined surface being configured to release an air bubble existing on the lower surface of the electric field shielding plate to the region without electric field shielding, wherein the electric field shielding plate extends from an outer peripheral portion of the plating tank toward a center of the plating tank, and the electric field shielding plate has: a ring-shaped portion connected to a whole circumference of the outer peripheral portion of the plating tank and having a ring shape in the top view, and a non-ring-shaped portion connected to a part of a circumference of the ring-shaped portion and having a non-ring shape in the top view.

5. The plating apparatus according to claim 4, further comprising a porous ionically resistive element configured to be arranged between the anode and the substrate in the inside of the plating tank, wherein the electric field shielding plate is arranged below the ionically resistive element or above the ionically resistive element.

6. The plating apparatus according to claim 4, wherein the inclined surface inclines such that a distance from a bottom portion of the plating tank increases while approaching the center of the plating tank.

* * * * *